US006019662A

United States Patent [19]

Fildan

[11] Patent Number: 6,019,662

[45] Date of Patent: Feb. 1, 2000

[54] BRASSIERE FRAME MEMBERS

[76] Inventor: Gerhard Fildan, Wohnpark Alte Erlas, Anton-Baumgartner Str. 44, C 2 21 01, A-1232 Vienna, Austria

[21] Appl. No.: 09/179,529

[22] Filed: Oct. 27, 1998

[51] Int. Cl.[7] ..... A41C 3/10

[52] U.S. Cl. ..... 450/41; 450/45; 450/48; 450/47; 2/255; 2/259; 2/260.1; 2/260; 2/264

[58] Field of Search ..... 450/41–53; 2/255–264

[56] References Cited

U.S. PATENT DOCUMENTS

| | | | |
|---|---|---|---|
| Re. 22,771 | 7/1946 | Licht | 450/41 |
| 2,463,319 | 3/1949 | Schwartz | 450/41 |
| 2,480,049 | 8/1949 | Rosenberg | 450/41 |
| 2,731,640 | 1/1956 | Garson | 450/41 |
| 2,769,180 | 11/1956 | Tareau et al. | 450/41 |
| 3,109,431 | 11/1963 | Jefferson . | |
| 3,114,374 | 12/1963 | Chalfin . | |
| 3,126,007 | 3/1964 | Jonas . | |
| 3,209,756 | 10/1965 | Rowell | 450/41 |
| 3,312,223 | 4/1967 | Wilson | 450/41 |
| 3,394,706 | 7/1968 | Simon . | |
| 3,599,643 | 8/1971 | Schwartz . | |
| 3,608,556 | 9/1971 | Paterson . | |
| 3,702,614 | 11/1972 | Miller . | |
| 3,717,154 | 2/1973 | Spetalnik . | |
| 3,722,513 | 3/1973 | Erteszek . | |
| 3,998,231 | 12/1976 | Delet . | |
| 4,133,316 | 1/1979 | Schwartz . | |
| 4,153,062 | 5/1979 | Delet . | |
| 4,201,220 | 5/1980 | Rowell . | |
| 4,203,449 | 5/1980 | Winzelberg . | |
| 4,275,740 | 6/1981 | Weston . | |
| 4,285,113 | 8/1981 | Rowell . | |
| 4,306,565 | 12/1981 | Rowell . | |
| 4,444,192 | 4/1984 | Stern . | |
| 4,770,650 | 9/1988 | Rowell . | |
| 4,798,557 | 1/1989 | Scott . | |
| 5,045,018 | 9/1991 | Costanzo . | |
| 5,141,470 | 8/1992 | Morgan . | |
| 5,167,891 | 12/1992 | Dijkman . | |
| 5,215,494 | 6/1993 | Flanagan . | |
| 5,387,150 | 2/1995 | Terrell . | |
| 5,527,202 | 6/1996 | Morgan . | |

*Primary Examiner*—Gloria M. Hale
*Attorney, Agent, or Firm*—Herbert Dubno

[57] ABSTRACT

An underwire for an underwire brassier has a metal wire bow provided at one end with a stitching flange and preferably formed at the other end with an elastomeric tip. A double-cup frame for the underwire brassiere has an inverted U-shaped bridge piece whose shanks receive the ends of plastic coated underwires. The shanks are connected unitarily by a bight which is flattened and can be grooved to increase flexibility. Upon twisting of the bight, the two underwires can be superposed, thereby increasing the flexibility of the frame and a brassiere in which the frame is incorporated.

20 Claims, 7 Drawing Sheets

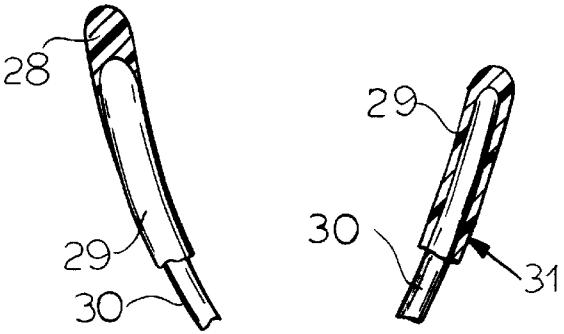
FIG.7
FIG.8
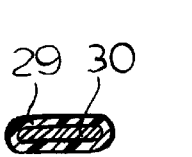
FIG.6
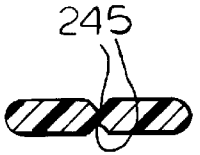
FIG.12
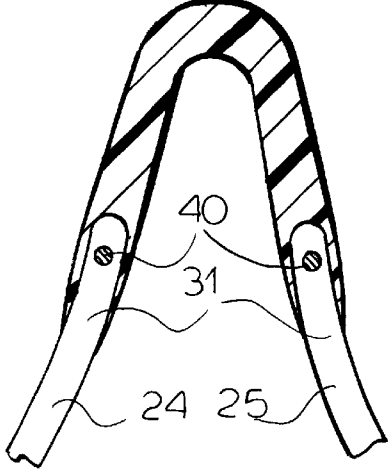
FIG.9
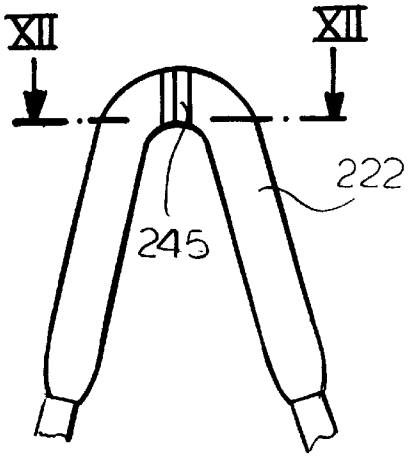
FIG.11
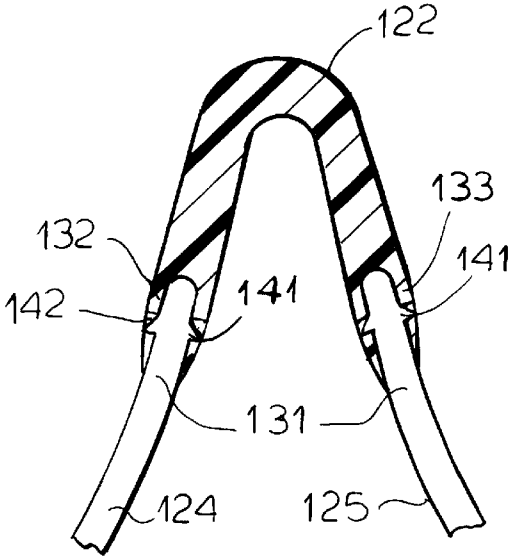
FIG.10

BRASSIERE FRAME MEMBERS

FIELD OF THE INVENTION

My present invention relates to an underwire for an underwire-type brassiere and adapted to be fitted into a pocket or channel below a brassiere cup. The invention also relates to a double-cup support frame for an underwire-type brassiere and, more particularly, to a support frame construction in which the underwires are connected by a bridge piece.

BACKGROUND OF THE INVENTION

Underwire brassieres are known and comprise below each cup, a channel or pocket receiving a so-called underwire which provides support and controls the shape of the cup and the brassiere.

A wide variety of underwires, both of metal and of plastic (synthetic resin) have been proposed and used and, in some cases, the underrwires have been coupled together into a brassiere frame by the continuity of the wire or by an additional member interconnecting the two wires.

In U.S. Pat. No. 4,275,740, for example, the brassiere frame has its arcuate wire members interconnected by a plastic hinge member which is of rectangular configuration. A more complex hinge arrangement, in which the underwires can swivel in eyes of the rectangular hinge member, is taught in U.S. Pat. No. 3,608,556.

Underwires, underwire brassieres and systems in which the wires may be protected against penetration through the fabric are described in any number of patents including:

U.S. Pat. No. 4,306,565
U.S. Pat. No. 4,770,650
U.S. Pat. No. 4,133,316
U.S. Pat. No. 3,114,374
U.S. Pat. No. 5,527,202
U.S. Pat. No. 5,215,494
U.S. Pat. No. 5,167,891
U.S. Pat. No. 5,141,470
U.S. Pat. No. 5,045,018
U.S. Pat. No. 4,798,557
U.S. Pat. No. 5,387,150
U.S. Pat. No. 4,444,192
U.S. Pat. No. 4,285,113
U.S. Pat. No. 4,203,449
U.S. Pat. No. 4,201,220
U.S. Pat. No. 4,153,062
U.S. Pat. No. 3,998,231
U.S. Pat. No. 3,722,513
U.S. Pat. No. 3,717,154
U.S. Pat. No. 3,702,614
U.S. Pat. No. 3,599,643
U.S. Pat. No. 3,394,706
U.S. Pat. No. 3,126,007
U.S. Pat. No. 3,109,431

The problems which have been recognized in the past in connection with such underwires include penetration of the brassiere fabric by an end of an underwire in use or upon laundering, lack of flexibility of the brassiere for purposes of wearing or storage, inadequate shaping of the brassiere, insufficient support, excessive bulkiness of the underwire system or the prior art hinge structures, and problems with respect to the insertion or stitching of the underwire frame or the underwires in place in the brassiere.

It has been found that the earlier systems have not been fully satisfactory in all of the foregoing respects and, for example, prior hinge structures were incapable of permitting the flexibility of the brassiere frame which was desired or required and otherwise did not satisfy the needs where the underwires are to be coupled together. It is true that an earlier support systems has utilized a fully unitary wire having a pair of underwire portions interconnected by an arcuate portion of the same wire and fabricated from a circular cross section metal wire. That system also has proved to be unsatisfactory largely because of the stiffness of the frame.

In the case in which a separate underwire is provided for each cup, i.e. the underwires are not interconnected, the problem of poke-through has been especially significant where the underwire is of the metal type. Metal underwires, whether or not coated with plastic, have been prone to damage washing machines, especially those of the tumbler type, so that the use of metal wires in brassieres has been avoided in some cases, in spite of the fact that in many situations, a metal wire is necessary or desirable in providing the support and shape.

OBJECTS OF THE INVENTION

The principal object of the present invention is to provide an improved frame member for a brassiere, i.e. an underwire, which avoids the disadvantages given previously, especially for metal underwires, but nevertheless provides sufficient shape and support for a brassiere cup or a pair of brassiere cups.

It is also an object of the invention, therefore, to provide an individual metal underwire which does not poke through the brassiere fabric, i.e. the fabric of the channel in which the underwire is received, affords improved comfort for the wearer and, in addition, poses less of a danger to washing machines or to sensitive fabrics which may come into contact with the brassiere during washing or otherwise.

It is a further object of the present invention to provide an improved double-cup frame for an underwire brassiere whereby the drawbacks detailed above can be obviated.

Another object of the invention is to provide an improved frame from an underwire brassiere which ensures effective support and shaping, can be incorporated into a brassiere with a minimum of bulkiness and no danger of penetration through the fabric, and yet has flexibility to the extent that one cup can be folded over another, for example for storage of the brassiere in a drawer or the like.

SUMMARY OF THE INVENTION

According to the present invention, an underwire for a brassiere may be provided at a free end thereof with a rubber tip or a tip of some other soft, elastic and preferably elastomeric material, and with a plastic sewing flange at an opposite end thereof, through which the underwire is stitched to the fabric. Between the flange and the rubber tip, the underwire may be a flat metal underwire which can be, for example, coated with a synthetic resin material, e.g. by a powder coating technique.

It has been found to be advantageous to form the sewing flange of the same type of plastic as forms the powder coating and to provide the metal underwire on which the tips are provided, so that it is rounded.

According to a feature of this aspect of the invention both the sewing flange and the rubber tip are injection molded onto the metal underwire and to promote retention of the sewing flange and the rubber tip to the metal underwire, the latter may be provided with a formation, especially a notch, hole or both, in which the injection-molded material can engage.

It has been found to be advantageous further to limit the stiffness of the metal underwire, e.g. by receiving the cross section of the metal underwire between the sewing flange or plastic tip and the rubber tip and to provide the rubber tip so that the metal underwire projects only part of the way into this rubber tip, i.e. the rubber tip has a significant portion of its length extending beyond the end of the metal underwire on which the rubber tip is provided. The sewing flange and the rubber tip can be of different colors to permit rapid orientation of the underwire when it is to be inserted into the tubular channel of the fabric brassiere in which that underwire is to be incorporated.

The end of the rubber tip can be bulbous shaped to further limit the tendency of poke through.

The invention also includes a double-cup support frame for a brassiere comprising a pair of arcuate resilient underwires adapted to be received in respective margins below cups of a brassiere and a separate inverted-U bridge piece having shanks each receiving one end of each of the underwires and affixed thereto, the shanks being formed in one piece with a flat bight normally coplanar with the underwires and intrinsically flexible and elastically deformable to enable one of the underwires to be folded over the other of the underwires by twisting or folding of the bridge piece along the length thereof.

Surprisingly, the flat plastic bridge piece, which is formed in one piece of inverted U section and has its shanks affixed to respective ends of the underwires, enables twisting of the shanks and hence folding of the bight so that one underwire can overlie the other, corresponding to separation of the cups, without the bulkiness of earlier hinge structures.

According to a feature of the invention the arcuate underwires are of flattened cross section and can comprise flattened metal wires which can be coated with plastic, e.g. by powder coating and the bigger piece can be injection molded onto the ends of the coated wires and can be constituted of the same plastic. Alternatively, the bridge piece may be press fitted onto the ends of the wires which can have barbs engaging in holes of the shanks. Advantageously, grooves can be formed in opposite faces of the bridge piece to increase the flexibility thereof, the grooves preferably running from one shank to the other. Alternatively, a defined bending point can be provided in the bridge piece, in the form of a thin zone, e.g. by providing two V-section grooves transverse to the bridge piece.

According to a feature of the invention the opposite end of each underwire can be provided with an additional plastic tip which is rounded and prevents the underwire from piercing through the fabric of the brassiere.

BRIEF DESCRIPTION OP THE DRAWING

The above and other objects, features, and advantages will become more readily apparent from the following description, reference being made to the accompanying drawing in which:

FIG. 6 is a cross section through the wire;

FIG. 7 is a detail, partly broken away, showing the plastic tip at an end of an underwire not received in the shank of a bridge piece;

FIG. 8 is a view of a portion of the latter shank with the sheath broken away;

FIG. 9 is a cross section through the bridge piece illustrating another embodiment of the invention;

FIG. 10 is another cross portion through the bridge piece of a further embodiment;

FIG. 11 is an elevational view of still another bridge piece according to the invention;

FIG. 12 is a section along the line XII—XII thereof;

SPECIFIC DESCRIPTION

Figure 1:
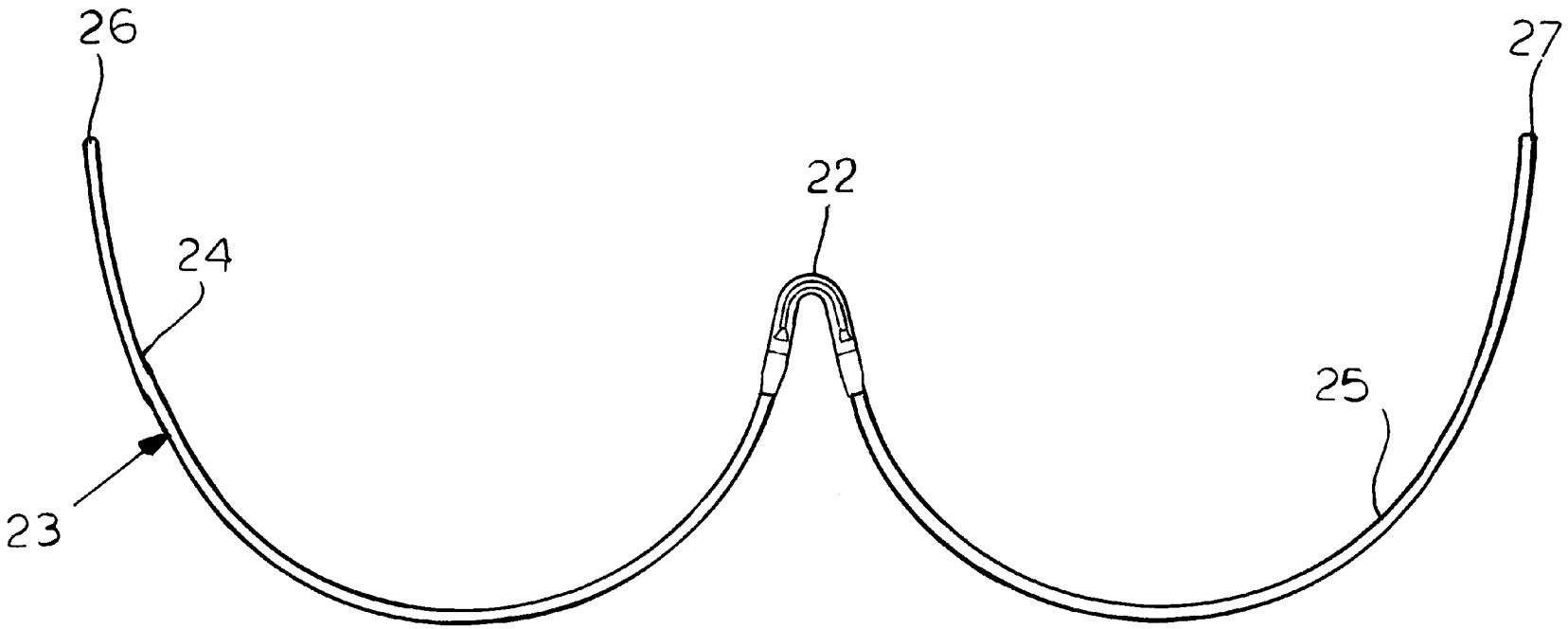
FIG. 1 is an elevational view of a double-cup frame according to the invention.
Figure 2:
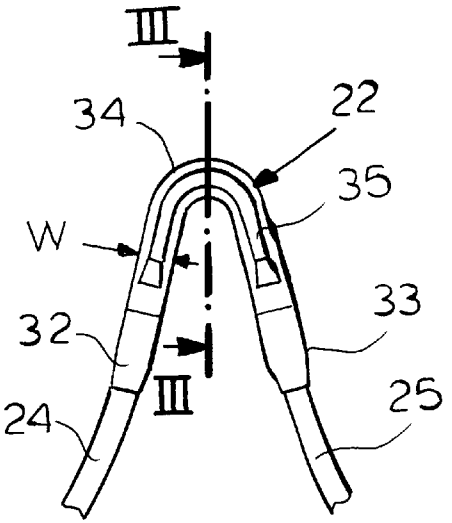
FIG. 2 is a detail view of the bridge piece.
Figure 3:
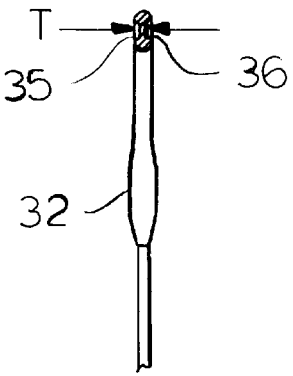
FIG. 3 is a section along the line III—III of FIG. 2.
Figure 4:
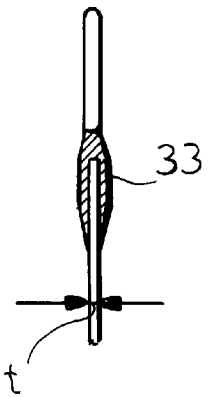
FIG. 4 is a side view of the bridge piece partly broken away through a shank thereof.
Figure 5:
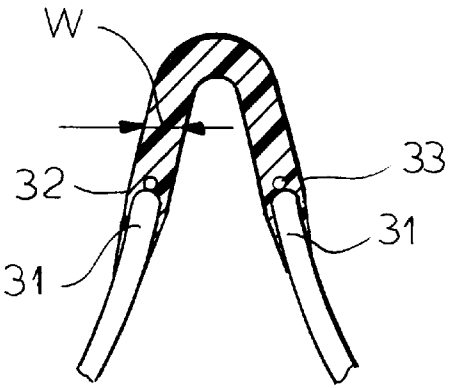
FIG. 5 is a longitudinal section through the bridge piece.
Figure 13:
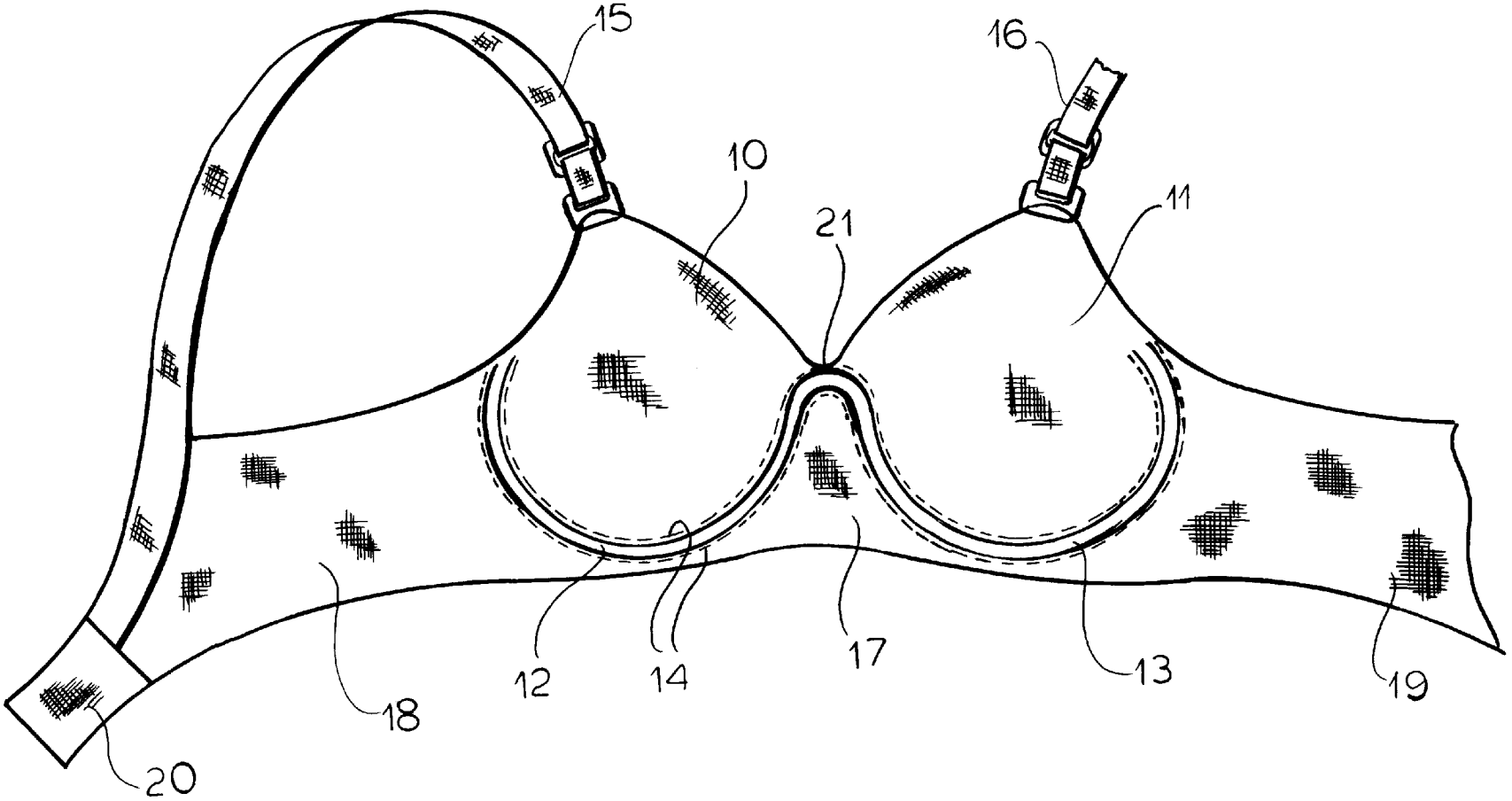
FIG. 13 is a view of a brassiere equipped with the double-cup frame of the invention.

The basic structure of an underwire brassiere has been illustrated in FIG. 13 and comprises two cups 10 and 11 which, along their underside, have respective pockets 12 and 13 which are arcuate and can receive an underwire below each cup. The pockets 12 and 13 are formed by stitching as represented at 14 and each cup can be provided with a shoulder strap 15, 16 and can be provided on a fabric web 17 which has extension portions 18 and 19 passing around to the back of the user where these two extensions can be interconnected by fasteners, one set of which can be provided on the tab 20. The central portion 21 between the cups may connect between the pockets 12 and 13 to receive a bridge piece 22 of the double-cup frame 23 shown in FIG. 1.

The frame 23 can comprise a pair of arcuate wires 24 and 25 whose free ends 26 and 27 can be blunted by injection molded plastic tips 28 (FIG. 7) which may be composed of the same plastic as the sheath 29 covering the metal core 30 of the respective underwire.

As can be seen from FIG. 8, the end 31 of the underwire received in the bridge piece 22 may also be provided with the plastic sheath 29, e.g. by a powder coating process.

In the embodiment of FIGS. 1–8, the bridge piece 22 is injection molded over the ends 30 of the underwires 24 and 25 so that the ends 31 project into the shanks 32 and 33 of the bridge piece. The shanks 32 and 33 are formed unitarily with a bight 34 which is of a constant width W equal to the width of the shank (see FIGS. 2 and 5) but which is flattened relative to the shank so as to have a thickness T and which is less than half the width W (FIG. 3) and may be just slightly greater than the thickness t of the underwire 24, 25.

The bight 34 is of inverted U shape and along its faces is formed with grooves 35, 36 to increase the flexibility of the bite. The remaining thickness between the floors of the grooves may be half the thickness T.

The bight 34 is composed of the same plastic as that which forms the sheath 29, the core 30 of which, as seen in FIG. 6, is flattened.

From FIG. 9, it will be seen that the ends 31 of the underwires 24 and 25 can be formed with holes 40 in which the injection molded material of the bridge piece 22 can be received to assist in anchoring the bridge piece 22 on the underwires.

From FIG. 10 it will be apparent that, in an alternative embodiment, the shanks 132 and 133 of a bridge piece 122 can be formed with sockets receiving the end portions 131 of the underwires 124, 125 which can be thrust into the sockets so that barbs 141 of the underwires engage in holes 142 in the sockets. In this case, the bridge pieces are preformed and forced over the end portions of the underwires.

Figure 14:
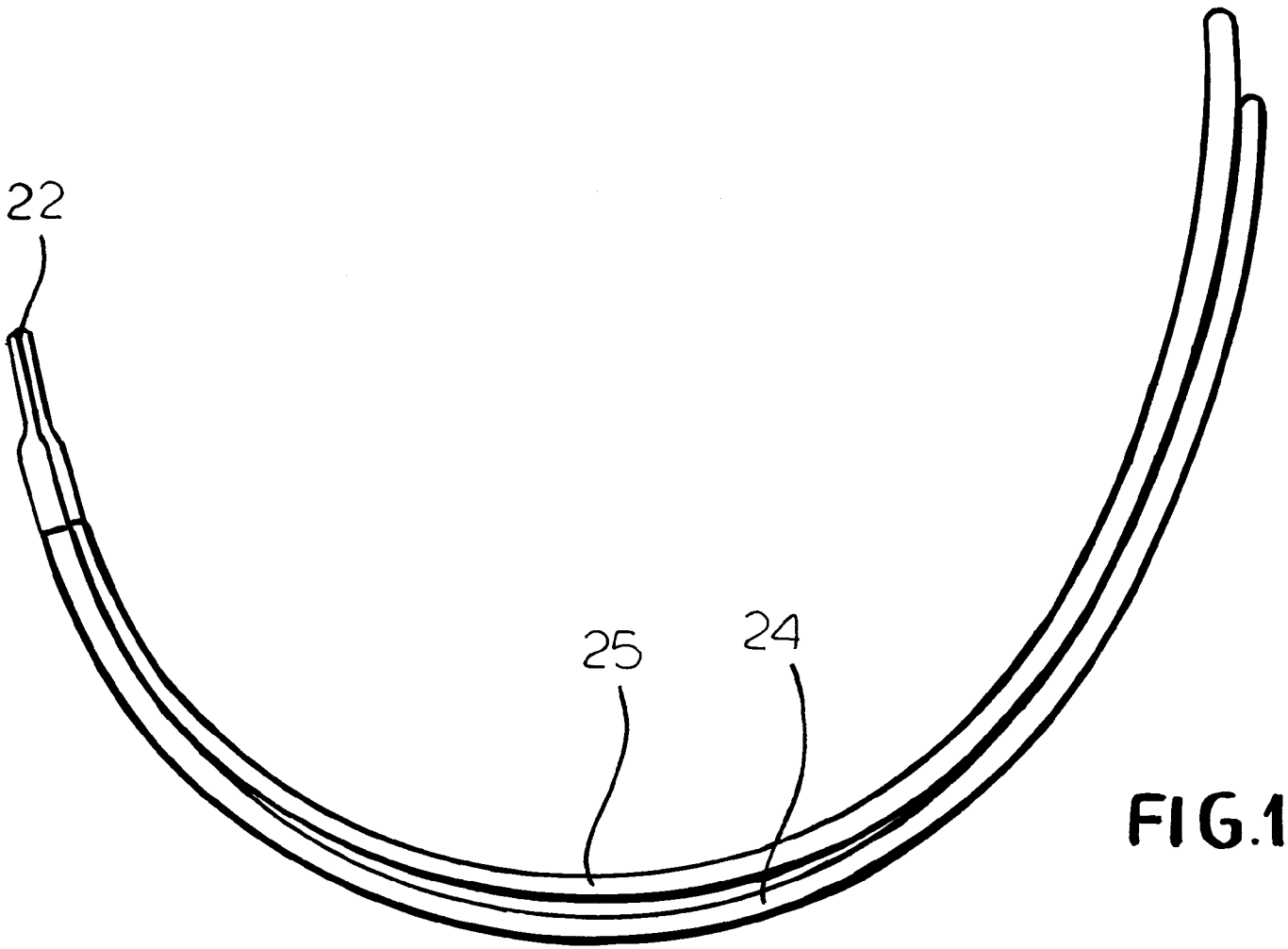
FIG. 14 is an illustration showing the folding over of one underwire onto the other to illustrate the flexibility of the frame of the invention.

As can be seen from FIG. 14, the result of the construction described is that, when one underwire 24 is folded over the other underwire 25, the bridge piece can twist usually between the shanks and at the flattened portions so that superposition of the wires is possible. Correspondingly, one cup of the brassiere can be folded over the other and thus the brassiere can be stored in a compact manner. Furthermore, because of the flatness of the bridge piece, little bulk is added to the brassiere while flexibility is provided between the underwires and the shape retentiveness is maximized. The plastic coated wire, especially where the additional safety tip is provided at the free end, precludes poking through the fabric of the brassiere in use or on washing and thus the brassiere is safe and convenient to use. Because the molded bridge piece bonds, during the molding process, to the sheath of the same plastic, an especially firm attachment is achieved.

As has been shown in FIGS. 11 and 12, the flexibility of the bridge piece 22 can be increased by providing V-shaped grooves 245 in opposite sides thereof so that only a portion of reduced thickness is present between the bottoms of these grooves. The grooves of FIGS. 11 and 12 can be used as an alternative or in addition to the grooves 35, 36. The underwire system of FIGS. 11 and 12 operates similarly to that of FIGS. 1–8.

Figure 15:
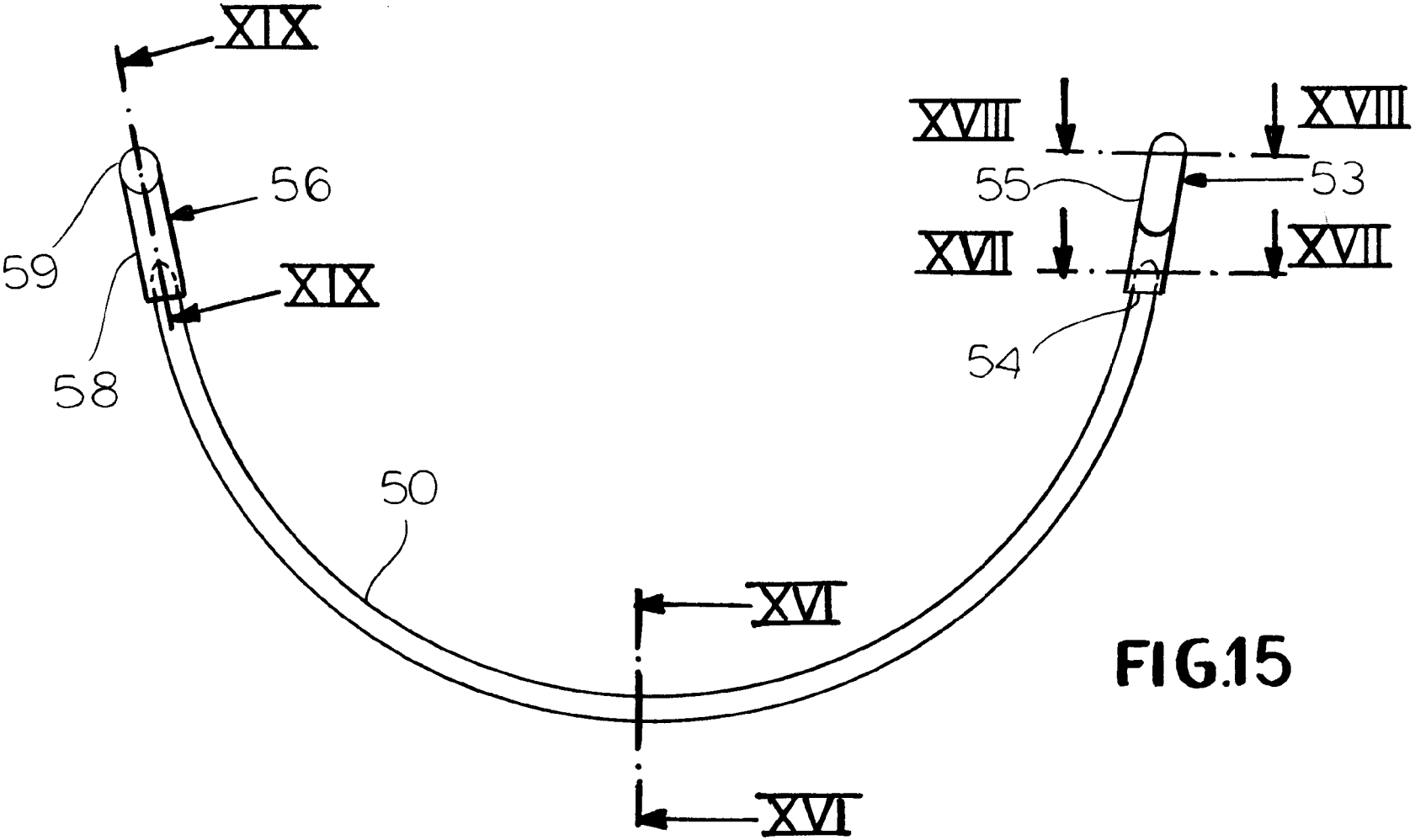
FIG. 15 is an elevational view of an individual underwire according to this invention provided with a rubber tip and with a sewing flange.
Figure 16:
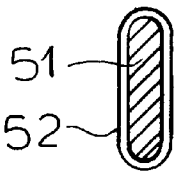
FIG. 16 is a cross sectional view taken along the line XVI—XVI of FIG. 15.
Figure 17:
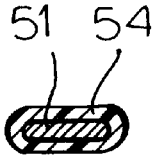
FIG. 17 is a cross sectional view taken along the line XVII—XVII of FIG. 15.
Figure 18:
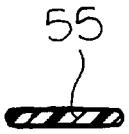
FIG. 18 is a cross sectional view taken along the line XVIII—XVIII of FIG. 15.
Figure 19:
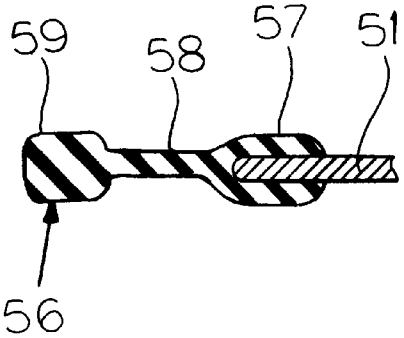
FIG. 19 is a cross sectional view taken along the line XIX—XIX of FIG. 15.

The underwire 50 shown in FIG. 15 is a flattened metal member or bow with a cross section, e.g. of the type at 51 and a powder coating 52 of a synthetic resin material similar to the plastics previously described and preferably corresponding to the plastic of a sewing flange 53 injection molded onto one end of the metal wire. The sewing flange has a sleeve portion 54 which surrounds the end of the metal wire 51 and, beyond the end of the metal wire, a thin region 55 readily pierced by the needle of a sewing machine so that the sewing flange can be stitched through, once the underwire is in its channel beneath the brassiere cup. The length of the sewing flange can be approximately half the length of the injection-molded tip, i.e. the sleeve portion 54 and the sewing flange 55 can be of approximately equal length.

When the plastic of the tip is the same as the coating 52 or comparable therewith, a melt bond is formed between the two to promote anchoring of the tip to the metal wire. On the opposite end of the metal wire another tip 56 is provided which can be of the type previously described or a sewing flange as represented at 53, but preferably is an elastomeric, e.g. rubber tip which has a sleeve portion 57 injection molded onto the end of the metal wires and bonded to its powder coating 52, a thin portion 58 adjacent the sleeve portion 57, and a bulbous portion 59 which is integral with the remainder of the tip. The entire tip can be soft and highly flexible.

As previously noted, the tips, if different, may be of different colors so as to enable the operator of feeding the wire into the channel in the brassiere to readily discern which is the sewing flange and which is the rubber tip. Analogously, both ends of the underwire can be provided with rubber tips as shown at 56 and stitching can be effected, if desired, through the thin region 58.

Figure 20:
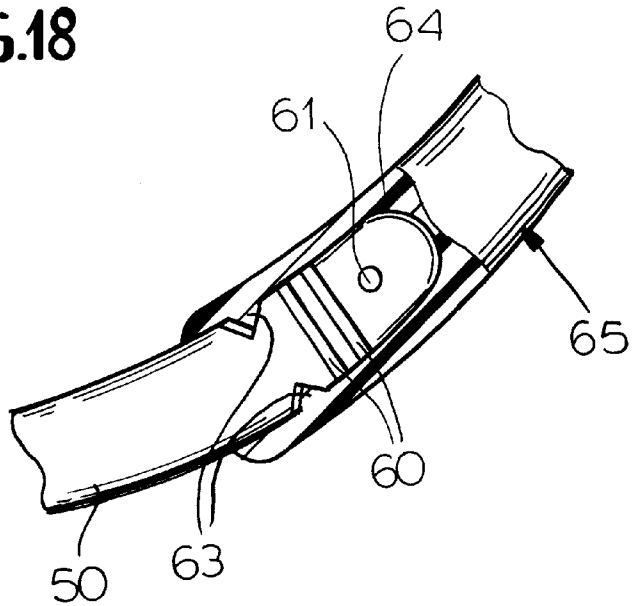
FIG. 20 is a detail view showing possible modifications of the ends of the metal underwire to promote attachment of the injection-molded members.

As can be seen from FIG. 20, the broad faces of the metal wire 50 can be grooved at 60 and/or one or more through-going holes 61 can be provided in the end of the wire and/or one or sore notches 63 can be provided along the edges of the wire, all to promote the attachment of the sleeve portion 64 of a tip 65 injection molded onto the metal wire and being either a sewing flange tip or a rubber tip as has been described.

I claim:

1. A double-cup support frame for a brassiere comprising a pair of arcuate resilient underwires adapted to be received in respective margins below cups of a brassiere and a separate inverted-U bridge piece having shanks each receiving one end of each of said underwires and affixed thereto, said shanks being formed in one piece with a flat bight normally coplanar with said underwires and intrinsically flexible and elastically deformable to enable one of said underwires to be folded over the other of said underwires.

2. The double-cup support frame as defined in claim 1 wherein each of said underwires comprises a metal core with a synthetic resin coating.

3. The double-cup support frame as defined in claim 1 wherein each of said wires has a flat cross section.

4. The double-cup support frame as defined in claim 1 wherein said shanks are molded over said wires.

5. The double-cup support frame as defined in claim 4 further comprising a hole formed in each of said ends of said underwires and receiving material of said bridge piece.

6. The double-cup support frame as defined in claim 1 wherein each of said shanks is a sleeve forced over the respective end of a respective underwire.

7. The double-cup support frame as defined in claim 6 wherein each of said ends of said underwires received in said sleeves is formed with a barb engageable in a hole of the respective sleeve.

8. The double-cup support frame as defined in claim 1 wherein said bight is formed with an arcuate groove in at least one side thereof to increase the flexibility of said bight.

9. The double-cup support frame as defined in claim 8 wherein a respective groove is formed in each of a pair of opposite sides of said bight to increase flexibility thereof.

10. The double-cup support frame as defined in claim 1 further comprising a V-section groove extending transversely across said bight at a center thereof.

11. The double-cup support frame as defined in claim 1 wherein each of said underwires is formed from a metal core coated with a plastic sheath and said bridge piece is injection molded frame the same plastic as said sheath.

12. The double-cup support frame as defined in claim 1 wherein each of said underwires has another end formed with a plastic tip molded thereover.

13. An underwire for a brassiere, adapted to be received in a channel beneath a cup of the brassiere and to be stitched to fabric of the brassiere at at least one end of the underwire, said underwire comprising:

a metal bow having a pair of ends and of flattened cross section;

a first injection-molded tip formed on one of said ends; and a second injection molded tip formed on another of said ends, said tips being selected from:

a stitching flange tip having a stitching flange extending beyond a respective end of the metal wire and adapted to be stitched through to said fabric, and a flexible elastomeric tip having a deflectable portion extending beyond a respective end of the metal bow.

14. The underwire defined in claim 13 wherein said bow is formed with said elastomeric tip at one end of said stitching flange tip at an opposite end.

15. The underwire defined in claim 14 wherein said bow is powder coated with a synthetic resin material.

16. The underwire defined in claim 15 wherein said bow is formed at least at one of said end with a formation increasing the attachment of a respective one of said tips to said bow.

17. The underwire defined in claim 16 wherein said formation is a throughgoing hole formed in said one of said ends.

18. The underwire defined in claim 16 wherein said formations include a groove across a flat portion of said one of said ends.

19. The underwire defined in claim 16 wherein said formations include a notch formed in an edge of said bow.

20. The underwire defined in claim 16 wherein said elastomeric tip is composed of rubber.

* * * * *